US010960434B2

(12) United States Patent
Saeki et al.

(10) Patent No.: US 10,960,434 B2
(45) Date of Patent: Mar. 30, 2021

(54) COATING APPARATUS AND COATING METHOD

(71) Applicant: Kabushiki Kaisha Toshiba, Minato-ku (JP)

(72) Inventors: Tatsuya Saeki, Yokohama (JP); Hiroaki Kobayashi, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 15/067,934

(22) Filed: Mar. 11, 2016

(65) Prior Publication Data

US 2016/0271636 A1 Sep. 22, 2016

(30) Foreign Application Priority Data

Mar. 18, 2015 (JP) ..... JP2015-055077

(51) Int. Cl.
*B05C 11/10* (2006.01)
*B05C 1/08* (2006.01)
*B05D 1/02* (2006.01)

(52) U.S. Cl.
CPC ..... *B05D 1/02* (2013.01); *B05C 1/0804* (2013.01); *B05C 1/0895* (2013.01); (Continued)

(58) Field of Classification Search
CPC ..... B05C 11/1039; B05C 1/08–10; B05B 12/082
See application file for complete search history.

(56) References Cited

U.S. PATENT DOCUMENTS 4,370,356 A 1/1983 Bok et al.
5,606,720 A * 2/1997 Verhoest ..... G03D 3/132 396/620

(Continued)

FOREIGN PATENT DOCUMENTS

JP 6-206027 7/1994
JP 7-273437 10/1995

(Continued)

OTHER PUBLICATIONS

Office Action dated Jul. 18, 2017 in Japanese Patent Application No. 2015-055077.

*Primary Examiner* — Dah-Wei D. Yuan
*Assistant Examiner* — Stephen A Kitt
(74) *Attorney, Agent, or Firm* — Oblon, McClelland, Maier & Neustadt, L.L.P.

(57) ABSTRACT

According to an embodiment, a coating apparatus includes an application head, a first moving device, a second moving device, a feeding device, and a suction device. The application head is opposed to a coating surface of a target with a predetermined distance, and forms a meniscus pillar of a coating material between the application head and the coating surface. The first moving device moves the application head. The second moving device moves the application head. The feeding device feeds the coating material between the application head and the coating surface of the target. The suction device sucks the coating material. A distance between the application head and the coating surface is made greater than the predetermined distance, and the coating material is sucked from the meniscus pillar by the suction device.

5 Claims, 8 Drawing Sheets

(52) U.S. Cl.
CPC ..... *B05C 11/1039* (2013.01); *B05C 1/0808* (2013.01); *B05C 1/0813* (2013.01)

(56) References Cited

U.S. PATENT DOCUMENTS

| | | | | |
|---|---|---|---|---|
| 5,871,584 | A * | 2/1999 | Tateyama | B05C 11/1039 118/319 |
| 2013/0074766 | A1 * | 3/2013 | Saeki | B05C 1/0813 118/429 |

FOREIGN PATENT DOCUMENTS

| | | |
|---|---|---|
| JP | 8-141475 | 6/1996 |
| JP | 11-276958 | 10/1999 |
| JP | 2003-164789 | 6/2003 |
| JP | 2013-66873 | 4/2013 |

* cited by examiner

COATING APPARATUS AND COATING METHOD

CROSS-REFERENCE TO RELATED APPLICATIONS

This application is based upon and claims the benefit of priority from Japanese Patent Application No. 2015-055077, filed Mar. 18, 2015, the entire contents of which are incorporated herein by reference.

FIELD

Embodiments of the present invention relate generally to a coating apparatus which applies a coating material to a target, and a coating method.

BACKGROUND

As a method of forming a film by applying a liquid coating material to a target such as a substrate, there is known a meniscus coating method which is conducted by an action of surface tension of a liquid coating material. In a coating apparatus using this meniscus coating method, a meniscus pillar, which is formed of a coating material, is formed between a coating surface of the target, to which the coating material is applied, and an application head. In the state in which the meniscus pillar is formed, the target and the application head are moved relative to each other along the coating surface. In this manner, the coating material is coated in a film form on the coating surface by the meniscus pillar which moves relatively on the coating surface.

DETAILED DESCRIPTION

The object of the present invention is to provide a coating apparatus and a coating method, which can precisely form a coating film on a target.

In general, according to one embodiment, a coating apparatus includes an application head, a first moving device, a second moving device, a feeding device, and a suction device. The application head is opposed to a coating surface of a target with a predetermined distance, and is configured to form a meniscus pillar of a coating material between the application head and the coating surface. The first moving device is configured to move the application head relative to the target along the coating surface. The second moving device is configured to move the application head relative to the target in a direction in which the coating surface and the application head move away from each other and in a direction in which the coating surface and the application head move toward each other. The feeding device is configured to feed the coating material between the application head and the coating surface of the target. The suction device is configured to suck the coating material. A distance between the application head and the coating surface is made greater than the predetermined distance, and the coating material is sucked from the meniscus pillar by the suction device.

A coating apparatus 1 according to a first embodiment will be described hereinafter with reference to FIG. 1 to FIG. 5.

Figure 1:
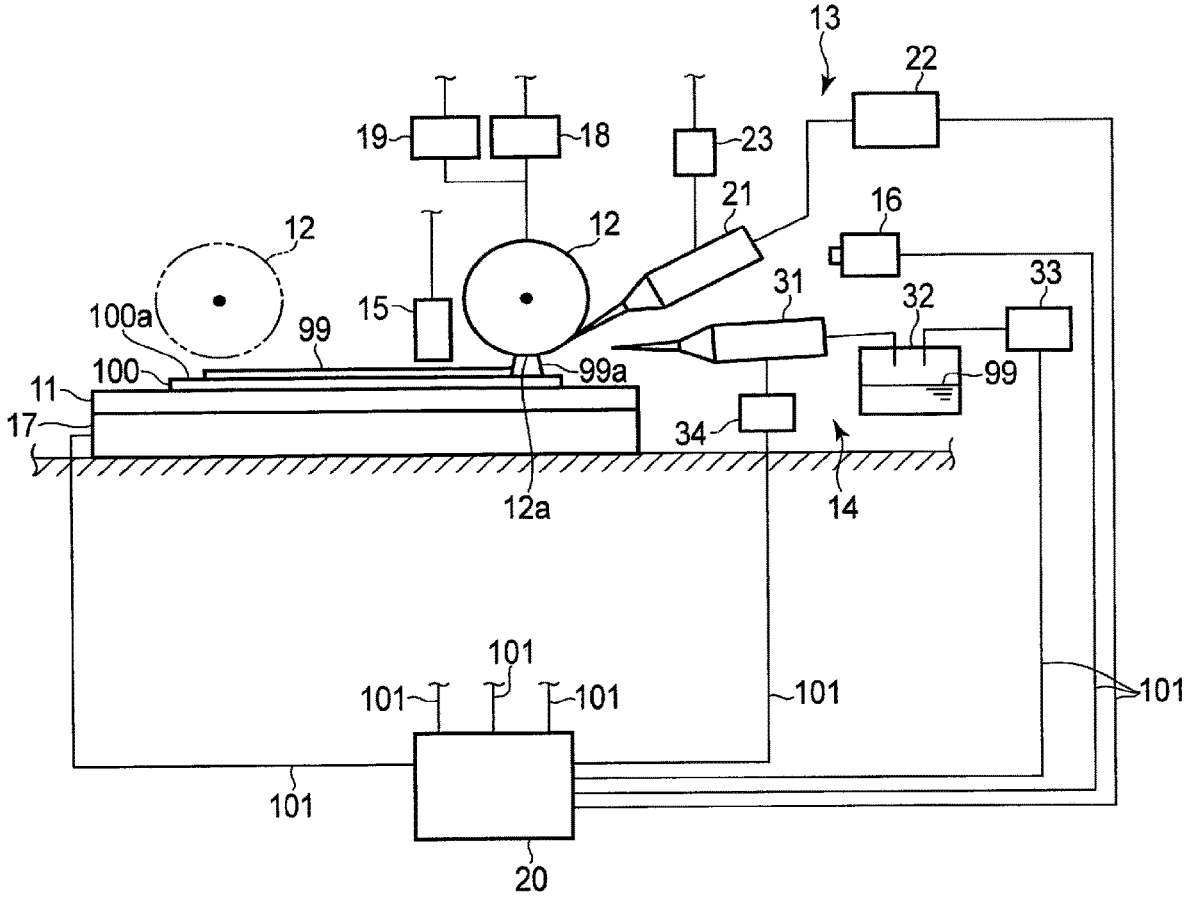
FIG. 1 is an explanatory view which schematically illustrates the structure of a coating apparatus according to a first embodiment.
Figure 2:
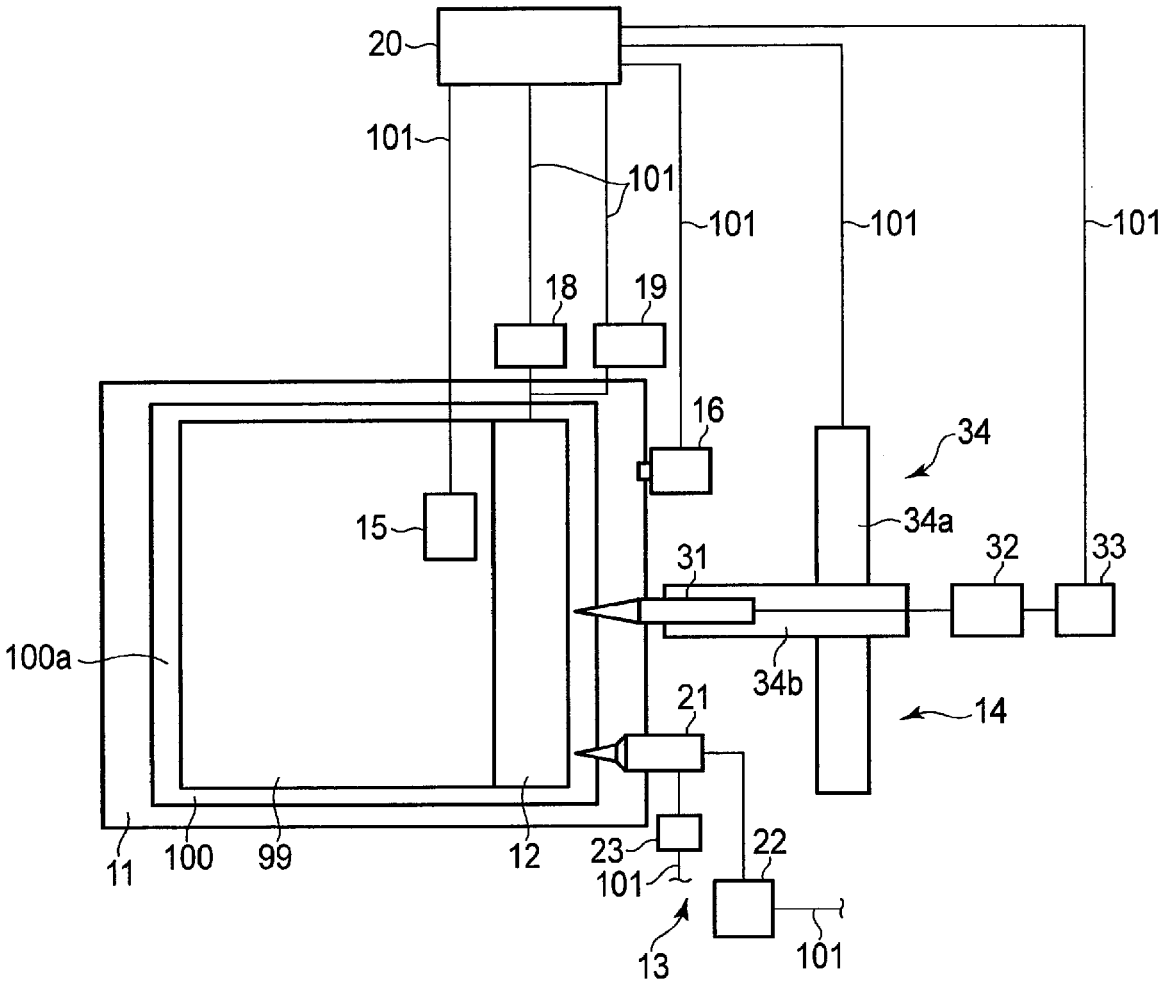
FIG. 2 is an explanatory view which schematically illustrates the structure of the coating apparatus.
Figure 3:
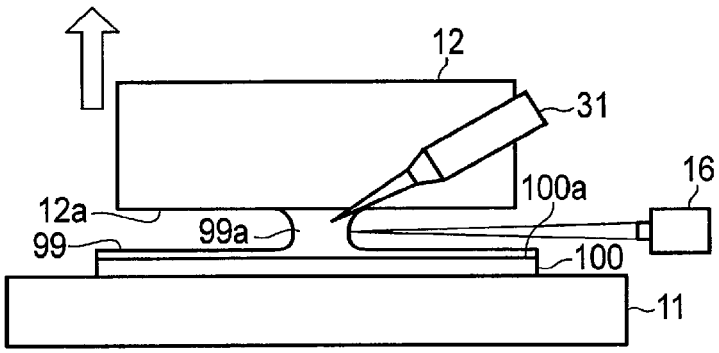
FIG. 3 is an explanatory view illustrating an example of suction of a coating material with use of the coating apparatus.
Figure 4:
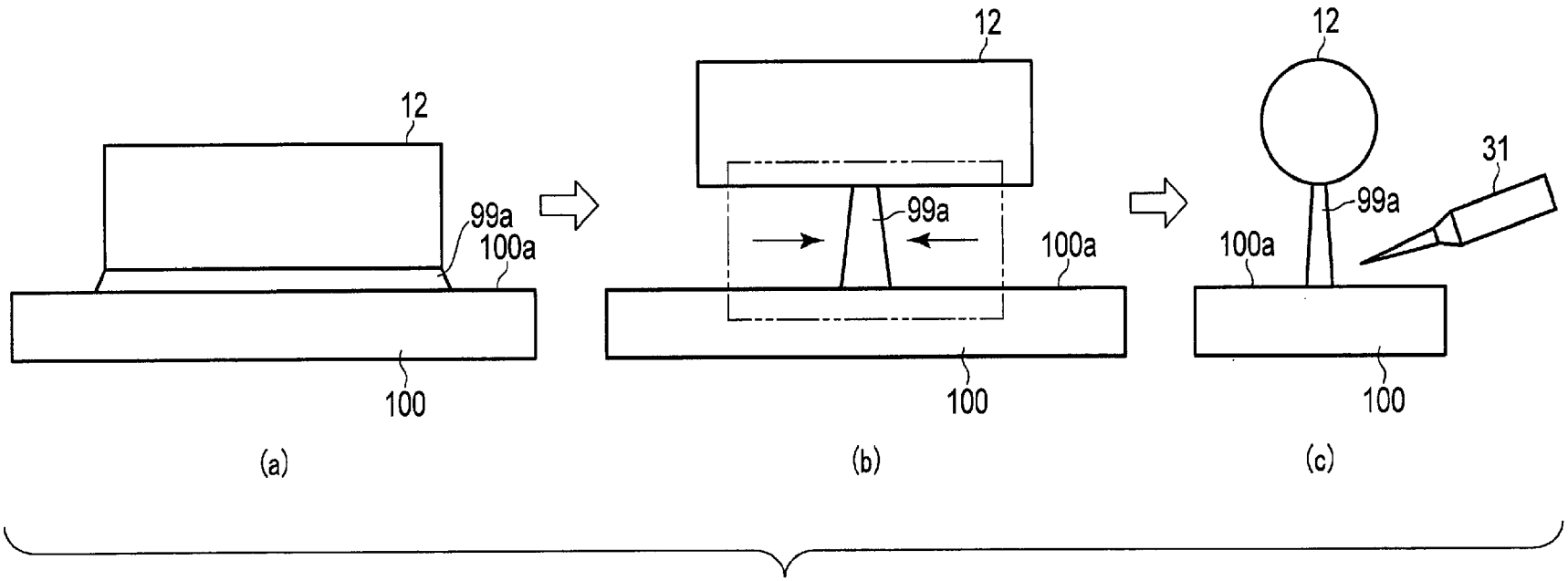
FIG. 4 is an explanatory view illustrating an example of suction of a coating material with use of the coating apparatus.
Figure 5:
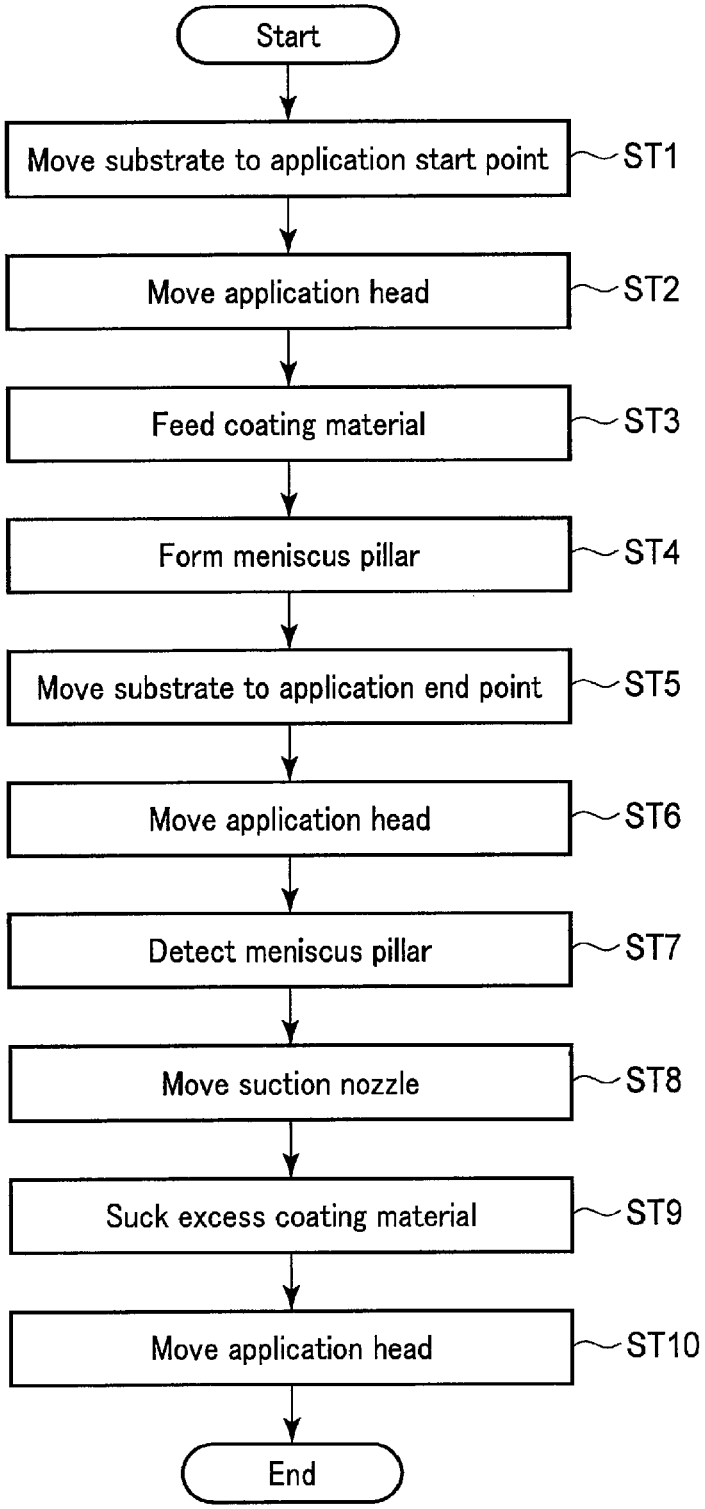
FIG. 5 is a flowchart illustrating an example of a coating method using the coating apparatus.

FIG. 1 is an explanatory view which schematically illustrates the structure of the coating apparatus 1 according to the first embodiment. FIG. 2 is an explanatory view which schematically illustrates the structure of the coating apparatus 1. FIG. 3 is an explanatory view illustrating an example of suction of a coating material 99 with use of the coating apparatus 1. FIG. 4 is an explanatory view illustrating an example of suction of a coating material with use of the coating apparatus 1. FIG. 5 is a flowchart illustrating an example of a coating method using the coating apparatus 1.

As illustrated in FIG. 1 and FIG. 2, the coating apparatus 1 includes a stage 11, an application head 12, a feeding device 13, a suction device 14, a first detection device 15, a second detection device 16, a first moving device 17, a second moving device 18, a rotating device 19, and a control device 20.

This coating apparatus 1 applies a coating material 99 in a film form on a coating surface 100*a* of a target 100, by causing a meniscus pillar 99*a* to occur on the coating surface 100*a* of the target 100 on the stage 11 by the coating material 99 which is fed to the application head 12 by the feeding device 13. Thus, the coating apparatus 1 is an apparatus which applies the coating material 99 to the target 100 by using a meniscus coating method.

In the meantime, a liquid material is used as the coating material 99. In addition, the target 100 is, for instance, a substrate. In the description below, the target 100 will be described as a substrate 100.

The stage 11 is configured such that the substrate 100 can be fixed to an upper surface of the stage 11. The stage 11 fixes, for example, the substrate 100 by suction.

The application head 12 is a so-called applicator. For example, the application head 12 is formed such that the shape thereof including its axis becomes a shape of a columnar body, such as a circular columnar shape or a polygonal columnar shape.

Here, by way of example, it is assumed that the application head 12 is formed such that the length in the axial direction (longitudinal direction) of the columnar body thereof is substantially equal to the length of the range of the coating material 99 that is applied to the substrate 100. In the present embodiment, the length in the axial direction (longitudinal direction) of the application head 12 can be restated as the length in the width direction of the application head 12.

The coating material 99 is fed by the feeding device 13 to the application head 12, that is, to at least a part of the outer peripheral surface along the axis of the application head 12. In addition, the meniscus pillar 99*a* is formed between at least a part of the outer peripheral surface along the axis of the application head 12 and the coating surface 100*a* of the substrate 100 that is the target. In the application head 12, a part where the meniscus pillar 99*a* is formed corresponds to a meniscus pillar forming portion 12*a*. The application head 12 is configured to be rotatable about the axis along the longitudinal direction thereof.

The feeding device 13 is configured to be capable of feeding the coating material 99, which is to be applied to the substrate 100, to an outer surface of the application head 12 other than the meniscus pillar forming portion 12*a*. The feeding device 13 includes a feeding nozzle 21 which discharges the coating material 99, a pump 22 which supplies the coating material 99 to the feeding nozzle 21, and a nozzle moving device 23 which moves the feeding nozzle 21 relative to the application head 12. The pump 22 is connected to the control device 20 via a signal line 101. The nozzle moving device 23 is connected to the control device 20 via a signal line 101.

The suction device 14 includes a suction nozzle 31, a suction tank 32, a vacuum pump 33, and a third moving device 34. The suction nozzle 31 is configured to be capable of sucking, from a distal end thereof, the coating material 99 which forms the meniscus pillar 99*a*. The suction tank 32 is configured to be capable of storing the sucked coating material 99. The vacuum pump 33 is connected by a piping or the like to the suction nozzle 31 via the suction tank 32. The vacuum pump 33 is connected to the control device 20 via a signal line 101.

The third moving device 34 is configured to be capable of moving the suction nozzle 31. For example, the third moving device 34 includes first moving means 34*a* which moves the suction nozzle 31 in the width direction of the application head 12, and second moving means 34*b* which moves the suction nozzle 31 in a direction perpendicular to the width direction, or, in other words, in directions toward and away from the application head 12. The third moving device 34 is connected to the control device 20 via a signal line 101.

The first detection device 15 is configured to be capable of detecting the position of the application head 12. To be more specific, the first detection device 15 is configured to be capable of detecting a gap between the meniscus pillar forming portion 12*a* of the application head 12 and the coating surface 100*a* of the substrate 100. The first detection device 15 is connected to the control device 20 via a signal line 101, and sends detected information to the control device 20.

The second detection device 16 is configured to be capable of detecting the meniscus pillar 99*a* which is formed by the application head 12. An optical camera or a laser measuring device, for instance, is used as the second detection device 16. The second detection device 16 is connected to the control device 20 via a signal line 101, and sends detected information to the control device 20.

The first moving device 17 is configured to be capable of moving the substrate 100 and application head 12 relative to each other in one direction. For example, the first moving device 17 is configured to be capable of moving the stage 11 in one direction, to be more specific, in a direction of coating of the coating material 99. The first moving device 17 is connected to the control device 20 via a signal line 101.

The second moving device 18 is configured to be capable of moving the application head 12 relative to the substrate 100, such that the application head 12 moves away from, and toward, the substrate 100 that is the target. For example, the second moving device 18 moves the application head 12 in a direction of gravity, relative to the substrate 100. The second moving device 18 is connected to the control device 20 via a signal line 101.

The rotating device 19 is configured to be capable of rotating the application head 12 about the axis of the application head 12. The rotating device 19 is connected to the control device 20 via a signal line 101.

The control device 20 is configured to be capable of moving the feeding nozzle 21 toward the application head 12 by controlling the nozzle moving device 23, and to be capable of feeding the coating material 99 from the feeding nozzle 21 to the application head 12 by controlling the pump 22.

The control device 20 is configured to be capable of moving, by controlling the first moving device 17, the substrate 100 from an application start position (application start point) of the coating material 99 to an application end position (application end point) of the coating material 99. The control device 20 is configured to be capable of moving, by controlling the second moving device 18, the application head 12 to such a height position that the gap between the substrate 100 and meniscus pillar forming portion 12*a* becomes such a gap as to be capable of forming the meniscus pillar 99*a*.

The control device 20 moves, by controlling the third moving device 34, the suction nozzle 31 to a position where the distal end of the suction nozzle 31 is opposed to the meniscus pillar 99*a*. The control device 20 is configured to be capable of sucking the coating material 99, which forms the meniscus pillar 99*a*, by controlling the vacuum pump 33.

Furthermore, the control device 20 includes a function (1) and a function (2).

Here, the function (1) is a function of executing, in the coating apparatus 1, such control as to apply the coating material 99 to the substrate 100 from the application start point to the application end point. The function (2) is a function of executing, in the coating apparatus 1, such control as to suck the coating material 99, which forms the meniscus pillar 99*a*, at the application end point.

Next, the function (1) and function (2), which the control device 20 includes, will be described.

The function (1) is a function of forming the meniscus pillar 99*a* by the application head 12 at the application start point of the substrate 100, and moving the substrate 100 in the state in which the meniscus pillar 99*a* is formed, thereby applying the coating material 99 to the coating surface 100*a* of the substrate 100 up to the application end point.

Specifically, by driving the first moving device 17, the function (1) drives the stage 11 such that the application start point of the substrate 100 is positioned below the application head 12, as indicated by a two-dot-and-dash line in FIG. 1. Incidentally, for the purpose of convenience in description, in FIG. 1, the application head 12 is indicated by a two-dot-and-dash line such that the application head 12 is positioned above the application start point.

Next, the feeding nozzle 21 is moved, and the coating material 99 is fed from the feeding nozzle 21 to the surface of the application head 12. In addition, by driving the second moving device 18, the application head 12 is moved to such a height position that the meniscus pillar 99*a* can be formed. Here, based on position information of the application head 12, which was detected by the first detection device 15, the application head 12 is lowered, and the application head 12 is moved closer to the substrate 100.

The gap between the coating surface 100*a* of the substrate 100 and the meniscus pillar forming portion 12*a* of the application head 12 is set to be a predetermined gap, and thereby the meniscus pillar 99*a* is formed on the coating surface 100*a*. In the meantime, at this time, the coating material 99 is fed to the application head 12 while the feeding nozzle 21 is being constantly moved in the longitudinal direction (width direction) of the application head 12, and thereby the meniscus pillar 99*a* is formed over the width direction of the application head 12.

In this state, by driving the first moving device 17, the coating material 99 with a predetermined film thickness is coated over the coating surface 100*a* of the substrate 100 until the application end point is positioned under the application head 12. Thus, the function (1) is the function of applying the coating material 99 from the application start point to application end point of the substrate 100 by the meniscus pillar 99*a* which is formed by the application head 12. In the meantime, the position of the application head 12 from the substrate 100 in the direction of gravity and the speed of movement of the substrate 100 are properly set in accordance with the film thickness of the coating material 99 that is applied, etc.

The function (2) is a function of sucking, by the suction device 14, the excess coating material 99, which forms the meniscus pillar 99*a*, at the application end point.

Specifically, the function (2) stops the feed of the coating material 99 after the substrate 100 has moved to the application end point. Then, the function (2) drives the second moving device 18, raises the application head 12 within the range of the height position at which the meniscus pillar 99*a* can be formed, and moves the application head 12 away from the substrate 100. By this movement of the application head 12, as illustrated in FIG. 3, the length of the meniscus pillar 99*a* in the width direction of the application head 12 decreases. Next, based on the position information of the meniscus pillar 99*a*, which was detected by the second detection device 16, the suction nozzle 31 is moved to a position where the suction nozzle 31 is opposed to the meniscus pillar 99*a*. Subsequently, the vacuum pump 33 is driven, and the coating material 99, which forms the meniscus pillar 99*a*, is sucked by the suction nozzle 31. Thus, the function (2) is the function of sucking the excess coating material 99, which forms the meniscus pillar 99*a*, at the application end point.

Next, referring to FIG. 1 to FIG. 5, a description is given of a coating method of the coating material 99 on the substrate 100, with use of the coating apparatus 1 having the above-described structure.

To start with, as indicated by a two-dot-and-dash line in FIG. 1, the control device 20 moves, by controlling the first moving device 17, the substrate 100 such that the application head 12 is positioned at the application start point (step ST1). At this time, the control device 20 rotates, by controlling the rotating device 19, the application head 12 such that the meniscus pillar forming portion 12*a* of the application head 12 is opposed to the substrate 100.

Next, the control device 20 moves the application head 12 closer to the substrate 100 at the application start point, so that the meniscus pillar 99*a* can be formed over the entire length in the width direction of the application head 12 (step ST2). Subsequently, the control device 20 feeds, by the feeding device 13, the coating material 99 to the surface of the application head 12 (step ST3). At this time, based on the position information of the application head 12, which was detected by the first detection device 15, the control device 20 sets the gap between the application head 12 and substrate 100 at a predetermined gap, thereby forming the meniscus pillar 99*a* between the meniscus pillar forming portion 12*a* of application head 12 and the coating surface 100*a* of substrate 100, as illustrated in part (a) of FIG. 4 (step ST4).

Next, the control device 20 moves the stage 11 to move the substrate 100 from the application start point to the application end point (step ST5), and applies the coating material 99 to the coating surface 100*a* of the substrate 100. In the meantime, when the control device 20 moves the substrate 100 from the application start point to application end point, the control device 20 detects the gap between the substrate 100 and application head 12 by the first detection device 15, and adjusts the height of the application head 12 so that this gap may become a predetermined gap.

After moving the substrate 100 to the application end point, the control device 20 stops the stage 11, raises the application head 12, and moves the application head 12 away from the substrate 100 (step ST6). At this time, the application head 12 is moved away from the substrate 100 with such a gap as to be capable of keeping the state in which the meniscus pillar 99*a* is formed. Thereby, as illustrated in FIG. 3 and part (b) of FIG. 4, the width of the meniscus pillar 99*a* is decreased.

Next, as indicated by a two-dot-and-dash line in part (b) of FIG. 4, the control device 20 detects, by the second detection device 16, the position of the meniscus pillar 99*a* over the entire length of the application head 12 (step ST7). Subsequently, as illustrated in part (c) of FIG. 4, the control device 20 moves the suction nozzle 31 to a position opposed to the position of the meniscus pillar 99*a* detected by the second detection device 16 (step ST8), and sucks an excess portion of the coating material 99, which forms the meniscus pillar 99*a*, by driving the vacuum pump (step ST9). After sucking the excess portion of the coating material 99, the control device 20 raises the application head 12 and moves the application head 12 further away from the substrate 100 (step ST10), thus completing the application of the coating material 99 to the substrate 100. By this coating method, the substrate 100, on which the coating material 99 is coated, is fabricated.

According to the coating apparatus 1 with the above-described structure, after the coating material 99 is applied to the substrate 100, the gap between the substrate 100 and application head 12 is increased while the state in which the meniscus pillar 99*a* is formed is maintained. Thereby, the excess portion (corresponding to the meniscus pillar 99*a*) of the coating material 99, which is formed over the entire length in the width direction of the application head 12, is gathered such that the excess portion is formed at a part of the application head 12 in the longitudinal direction (width direction). Thereafter, by sucking the coating material 99 which forms the meniscus pillar 99*a*, the excess coating material 99 at the application end point can be removed, and an increase in feed amount (film thickness) of the coating material 99 at the application end point can be suppressed. As a result, it becomes unnecessary to provide such an additional fabrication step as to remove, when the excess coating material 99 was applied to the substrate 100 at the application end point, the excess coating material 99 that was applied.

In addition, by detecting the position of the meniscus pillar 99*a* by the second detection device 16, the meniscus pillar 99*a* can exactly be sucked by the suction device 14. Specifically, in the case in which the meniscus pillar forming portion 12*a* of the application head 12 is formed uniformly along the plane direction of the substrate 100, the meniscus pillar 99*a*, whose length in the width direction of the application head 12 was decreased by raising the application head 12, lies at an arbitrary position in the width direction of the application head 12. However, by detecting the meniscus pillar 99*a* whose length in the width direction of the application head 12 was decreased by raising the application head 12, the suction nozzle 31 can exactly be opposed to the meniscus pillar 99*a*, and the coating material 99, which forms the meniscus pillar 99*a*, can be sucked.

Furthermore, by adopting such a structure that the excess portion of the coating material 99, which forms the meniscus pillar 99*a*, is sucked by the suction device 14, there is no need to provide the application head 12 with a structure for removing the excess coating material 99, and the application head 12 may have a simple structure. Therefore, the cleaning of the application head 12 is easier, and the maintainability of the application head 12 can be secured.

As has been described above, according to the coating apparatus 1 relating to the first embodiment, on the coating surface 100*a* of the substrate 100 that is the target, the excess portion of the coating material 99 at the application end point is removed by the suction device 14. Thereby, on the coating surface 100*a* of the substrate 100, an increase in film thickness of the coating material 99 at the application end point can be suppressed.

Second Embodiment

Next, a coating apparatus 1A according to a second embodiment is described with reference to FIG. 6 and FIG. 7.

Figure 6:
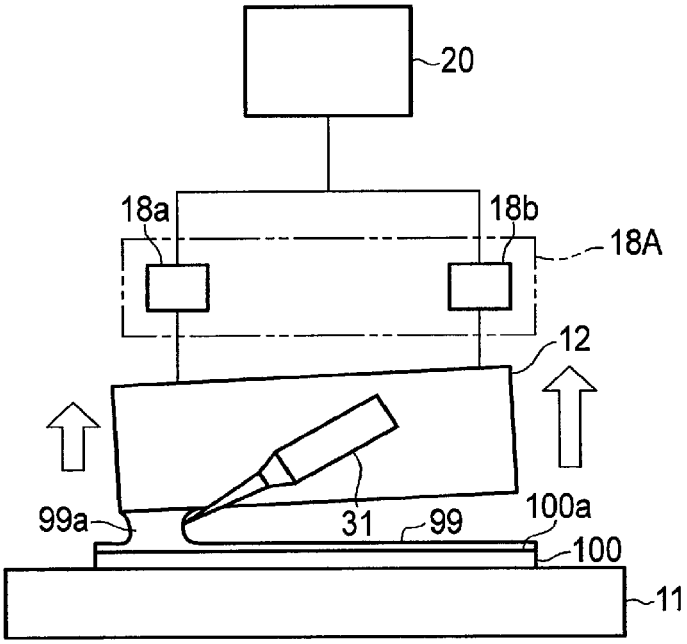
FIG. 6 is an explanatory view which schematically illustrates the structure of a coating apparatus according to a second embodiment.

FIG. 6 is an explanatory view which schematically illustrates the structure of the coating apparatus 1A according to the second embodiment, and illustrates an example of suction of the coating material 99. FIG. 7 is a flowchart illustrating an example of a coating method using the coating apparatus 1A. Incidentally, the same structural parts of the coating apparatus 1A of the second embodiment as those of the coating apparatus 1 of the above-described first embodiment are denoted by like reference numerals, and a detailed description thereof is omitted. In addition, in FIG. 6, the depiction of the structure of the coating apparatus 1A, other than the main structure thereof, is omitted.

As illustrated in FIG. 6, the coating apparatus 1A includes a stage 11, an application head 12, a feeding device 13, a suction device 14, a first detection device 15, a first moving device 17, a second moving device 18A, a rotating device 19, and a control device 20.

The second moving device 18A is configured to be capable of moving the application head 12 with different movement amounts on one end side and on the other end side of the application head 12. Specifically, the second moving device 18A includes one-end-side moving means 18*a* which moves one end side of the application head 12, and other-end-side moving means 18*b* which moves the other end side of the application head 12. The second moving device 18A is connected to the control device 20 via a signal line 101.

The control device 20 is configured to be capable of controlling the one-end-side moving means 18*a* and the other-end-side moving means 18*b* of the second moving device 18A.

In addition, the control device 20 includes the above-described function (1) and a function (3).

Here, the function (3) is a function of sucking, in the coating apparatus 1A, the coating material 99, which forms the meniscus pillar 99*a*, at the application end point.

Specifically, the function (3) stops the feed of the coating material 99 after the substrate 100 has moved to the application end point. Then, the function (3) controls the one-end-side moving means 18*a* and the other-end-side moving means 18*h* within the range of the height position at which the meniscus pillar 99*a* can be formed, and moves the application head 12 in a direction away from the substrate 100. At this time, the function (3) controls the one-end-side moving means 18*a* and the other-end-side moving means 18*b* such that the direction of extension of the meniscus pillar forming portion 12*a* of the application head 12 is inclined to the plane direction of the substrate 100.

As illustrated in FIG. 6, for example, the application head 12 is moved by setting the movement amount of the application head 12 by the one-end-side moving means 18*a* to be less than the movement amount of the application head 12 by the other-end-side moving means 12*b*. At this time, the application head 12 is moved so that the meniscus pillar forming portion 12*a* of the application head 12 moves away from the substrate 100 by such a degree that the meniscus pillar 99*a* is formed on one end side of the application head 12 but the meniscus pillar 99*a* is not formed on the other end side of the application head 12.

By this movement of the application head 12, the length of the meniscus pillar 99*a* in the width direction of the application head 12 decreases. In addition, the meniscus pillar 99*a* is formed only on one end side of the application head 12. Subsequently, the vacuum pump 33 is driven, and the coating material 99, which forms the meniscus pillar 99*a*, is sucked by the suction nozzle 31.

As described above, the function (3) is the function of forming the meniscus pillar 99*a* only on one end side of the application head 12 by positioning the meniscus pillar forming portion 12*a* of the application head 12 at the application end point with an inclination in the height direction relative to the substrate 100, and sucking the excess coating material 99 which forms the meniscus pillar 99*a*.

Figure 7:
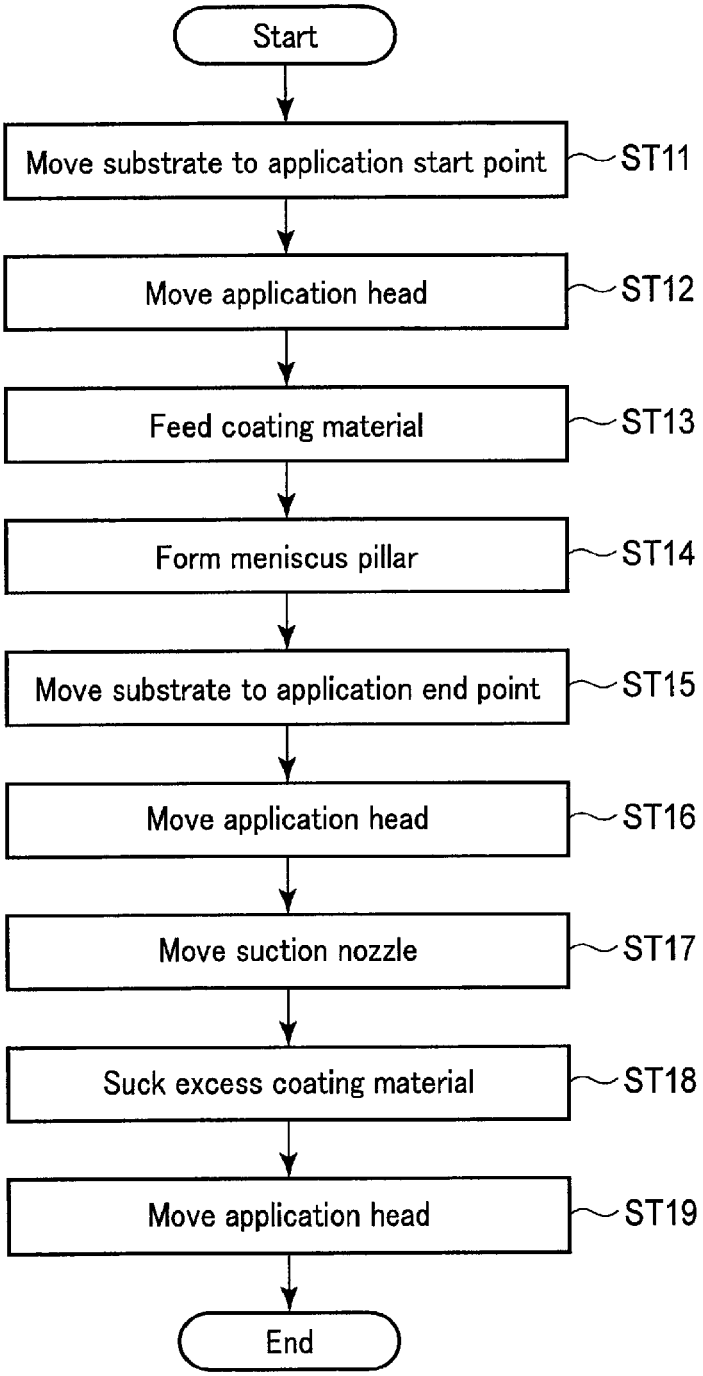
FIG. 7 is a flowchart illustrating an example of a coating method using the coating apparatus of the second embodiment.

Next, referring to FIG. 6 and FIG. 7, a description is given of a coating method of the coating material 99 on the substrate 100, with use of the coating apparatus 1A having the above-described structure.

To start with, the control device 20 moves, by controlling the first moving device 17, the substrate 100 such that the application head 12 is positioned at the application start point (step ST11). At this time, the control device 20 rotates, by controlling the rotating device 19, the application head 12 such that the meniscus pillar forming portion 12*a* of the application head 12 is opposed to the substrate 100.

Next, the control device 20 moves the application head 12 closer to the substrate 100 at the application start point, so that the meniscus pillar 99*a* can be formed over the entire length in the width direction of the application head 12 (step ST12). Subsequently, the control device 20 feeds, by the feeding device 13, the coating material 99 to the surfaces of the application head 12 (step ST13).

At this time, based on the position information of the application head 12, which was detected by the first detection device 15, the control device 20 sets the gap between the application head 12 and substrate 100 at a predetermined gap. Thereby, the control device 20 forms the meniscus pillar 99*a* between the meniscus pillar forming portion 12*a* of application head 12 and the coating surface 100*a* of substrate 100 (step ST14).

Next, the control device 20 moves the stage 11 to move the substrate 100 from the application start point to the application end point (step ST15), and applies the coating material 99 to the coating surface 100*a* of the substrate 100. In the meantime, when the control device 20 moves the substrate 100 from the application start point to application end point, the control device 20 detects the gap between the substrate 100 and application head 12 by the first detection device 15, and adjusts the height of the application head 12 so that this gap may become a predetermined gap.

After moving the substrate 100 to the application end point, the control device 20 stops the stage 11, raises the application head 12, and moves the application head 12 away from the substrate 100 (step ST16). At this time, the control device 20 moves, by the one-end-side moving means 18*a* and the other-end-side moving means 18*b*, the application head 12 in a direction opposite to the direction of gravity with different movement amounts on both end sides of the application head 12, and moves the application head 12 away from the substrate 100 such that the application head 12 is positioned with an inclination to the substrate 100. Thereby, the width of the meniscus pillar 99*a* is decreased, and the meniscus pillar 99*a* moves to a position where the gap between the application head 12 and substrate 100 is narrow, for example, to on one end side of the application head 12. In this manner, by maintaining the state in which the meniscus pillar 99*a* is formed on one end side of the application head 12, the control device 20 decreases the width of the meniscus pillar 99*a*, as illustrated in FIG. 6.

Next, the control device 20 moves the suction nozzle 31 to the meniscus pillar 99*a* (step ST17), and sucks the excess coating material 99, which forms the meniscus pillar 99*a*, by driving the vacuum pump 33 (step ST18). In the meantime, by making different the movement amounts of the one-end-side moving means 18*a* and the other-end-side moving means 18*b*, the meniscus pillar 99*a* moves to either end side of the application head 12, it should suffice if the suction nozzle 31 is moved to this end side of the application head 12.

After sucking the excess coating material 99, the control device 20 raises the application head 12 and moves the application head 12 further away from the substrate 100 (step ST19), thus completing the application of the coating material 99 to the substrate 100. By this coating method, the substrate 100, on which the coating material 99 is coated, is fabricated.

According to the coating apparatus 1A with the above-described structure, like the above-described coating apparatus 1, by removing the excess coating material 99 at the application end point by the suction device 14, an increase in film thickness of the coating material 99 at the application end point can be suppressed.

In addition, in the coating apparatus 1A, the position of the meniscus pillar 99*a* can easily be controlled by such a simple structure that the movement amount of the application head 12, which moves away from the substrate 100 in the vertical direction, is made different between both end sides of the application head 12. Thus, after the end of application of the coating material 99, the meniscus pillar 99*a*, which is formed by the excess coating material 99, can be located at the same position, and suction becomes easier. Therefore, there is no need to detect the meniscus pillar 99*a* by the second detection device 16, and the manufacturing cost of the coating apparatus 1A can be reduced.

Third Embodiment

Next, a coating apparatus 1B according to a third embodiment is described with reference to FIG. 8 and FIG. 9.

Figure 8:
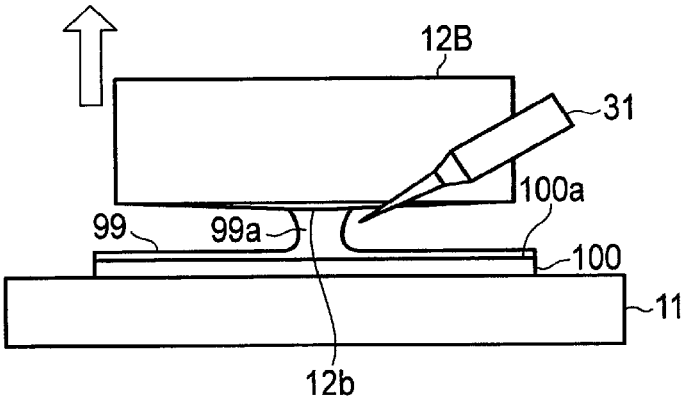
FIG. 8 is an explanatory view which schematically illustrates the structure of a coating apparatus according to a third embodiment.

FIG. 8 is an explanatory view which schematically illustrates the structure of the coating apparatus 1B according to the third embodiment, and illustrates an example of suction of the coating material 99. FIG. 9 is a flowchart illustrating an example of a coating method using the coating apparatus 1B. Incidentally, the same structural parts of the coating apparatus 1B of the third embodiment as those of the coating apparatus 1 of the above-described first embodiment are denoted by like reference numerals, and a detailed description thereof is omitted. In addition, in FIG. 8, the depiction of the structure of the coating apparatus 1B, other than the main structure thereof, is omitted.

As illustrated in FIG. 8, the coating apparatus 1B includes a stage 11, an application head 12B, a feeding device 13, a suction device 14, a first detection device 15, a first moving device 17, a second moving device 18, a rotating device 19, and a control device 20.

The application head 12B is a so-called applicator. For example, the application head 12B is formed such that the shape thereof including its axis becomes a shape of a columnar body, such as a circular columnar shape or a polygonal columnar shape. The application head 12B is formed such that the length in the axial direction (longitudinal direction) thereof is substantially equal to the length of the range of the coating material 99 that is applied to the substrate 100.

The application head 12B includes a meniscus pillar forming portion 12*a* which forms a meniscus pillar 99*a* on a part of the outer peripheral surface in the axial direction of the application head 12B, and a projection portion 12*b* at which a part of the outer peripheral surface in the axial direction projects. The application head 12B is configured to be rotatable about the axis along the longitudinal direction thereof.

The projection portion 12*b* is configured such that a part in the axial direction of the application head 12B projects from the outside diameter of the outer peripheral surface of the application head 12B. Specifically, the projection portion 12*b* is configured such that a part in the axial direction of the outer peripheral surface of the application head 12B gradually inclines from both end portions of the application head 12 toward a central portion of the application head 12B, and projects at the central portion of the application head 12B. In addition, the projection portion 12*b* is formed on the outer peripheral surface of the application head 12B, such that the projection portion 12*b* is spaced apart from the meniscus pillar forming portion 12*a* by a predetermined angle.

The control device 20 includes the above-described function (1) and a function (4).

Here, the function (4) is a function of sucking, in the coating apparatus 1B, the coating material 99, which forms the meniscus pillar 99*a*, at the application end point.

Specifically, the function (4) stops the feed of the coating material 99 after the substrate 100 has moved to the application end point. Then, the function (4) rotates the application head 12B by the rotating device 19, and locates the projection portion 12*b* to be opposed to the substrate 100. In addition the function (4) moves the application head 12B in a direction away from the substrate 100, within the range of the height position at which the meniscus pillar 99*a* can be formed. By the rotation and movement of the application head 12, the meniscus pillar 99*a* moves in a manner to gather at an apex part of the projection portion 12*b*, and the length of the meniscus pillar 99*a* in the width direction of the application head 12B decreases. Next, the suction nozzle 31 is moved to a position where the suction nozzle 31 is opposed to the meniscus pillar 99*a*, or, in other words, a position where the suction nozzle 31 is opposed to the apex part of the projection portion 12*b*. Subsequently, the vacuum pump 33 is driven, and the excess portion of the coating material 99, which forms the meniscus pillar 99*a*, is sucked by the suction nozzle 31. Thus, the function (4) is the function of sucking the excess coating material 99, which forms the meniscus pillar 99*a*, at the application end point.

Figure 9:
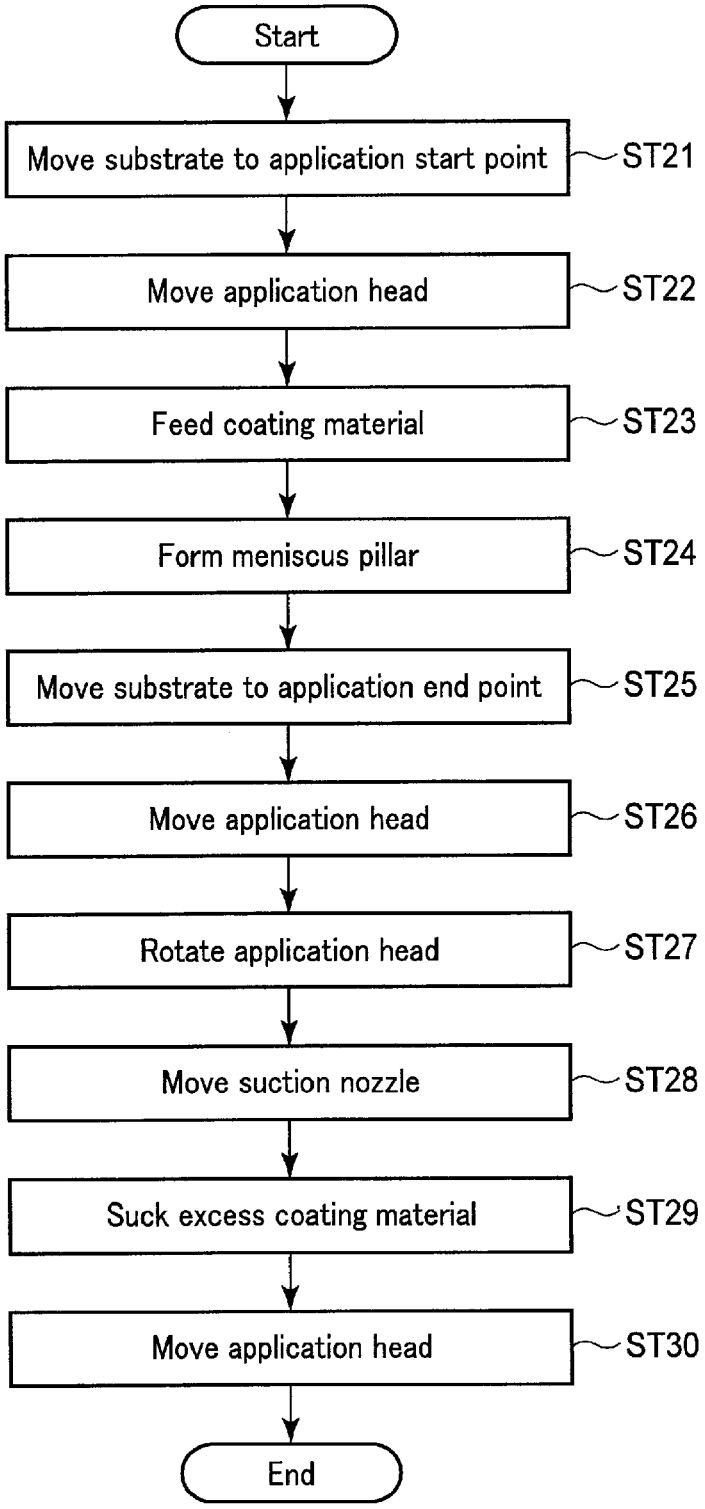
FIG. 9 is a flowchart illustrating an example of a coating method using the coating apparatus of the third embodiment.

Next, referring to FIG. 8 to FIG. 9, a description is given of a coating method of the coating material 99 on the substrate 100, with use of the coating apparatus 1B having the above-described structure.

To start with, the control device 20 moves, by controlling the first moving device 17, the substrate 100 such that the application head 12B is positioned at the application start point (step ST21). At this time, the control device 20 rotates, by controlling the rotating device 19, the application head 12B such that the meniscus pillar forming portion 12*a* of the application head 12B is opposed to the substrate 100.

Next, the control device 20 moves the application head 12B closer to the substrate 100 at the application start point, so that the meniscus pillar 99*a* can be formed over the entire length in the width direction of the application head 12B (step ST22).

Subsequently, the control device 20 feeds, by controlling the feeding device 13, the coating material 99 to the surface of the application head 12B (step ST23).

At this time, based on the position information of the application head 12B, which was detected by the first detection device 15, the control device 20 sets the gap between the application head 12B and substrate 100 at a predetermined gap, thereby forming the meniscus pillar 99*a* between the meniscus pillar forming portion 12*a* of application head 12B and the coating surface 100*a* of substrate 100 (step ST24).

Next, the control device 20 moves the stage 11 to move the substrate 100 from the application start point to the application end point (step ST25), and applies the coating material 99 to the coating surface 100*a* of the substrate 100. In the meantime, when the control device 20 moves the substrate 100 from the application start point to application end point, the control device 20 detects the gap between the substrate 100 and application head 12B by the first detection device 15, and adjusts the height of the application head 12B so that this gap may become a predetermined gap.

After moving the substrate 100 to the application end point, the control device 20 stops the stage 11, raises the application head 12B, and moves the application head 12B away from the substrate 100 (step ST26). At this time, the control device 20 rotates, by controlling the rotating device 19, the application head 12B (step ST27), and locates the projection portion 12*b* to be opposed to the substrate 100. In addition, while maintaining the state in which the meniscus pillar 99*a* is formed, the control device 20 moves the application head 12B away from the substrate 100. Thereby, as illustrated in FIG. 8, the control device 20 moves the meniscus pillar 99*a* by decreasing the width of the meniscus pillar 99*a* such that the meniscus pillar 99*a* gathers at the apex part of the projection portion 12*b*.

Subsequently, the control device 20 moves the suction nozzle 31 to the meniscus pillar 99*a* (step ST28), and sucks an excess portion of the coating material 99, which forms the meniscus pillar 99*a*, by driving the vacuum pump 33 (step ST29).

After sucking the coating material 99, the control device 20 raises the application head 12B and moves the application head 12B further away from the substrate 100 (step ST30), thus completing the application of the coating material 99 to the substrate 100. By this coating method, the substrate 100, on which the coating material 99 is coated, is fabricated.

According to the coating apparatus 1B with the above-described structure, like the above-described coating apparatus 1, by removing the excess coating material 99 at the application end point by the suction device 14, an increase in film thickness of the coating material 99 at the application end point can be suppressed.

In addition, in the coating apparatus 1B, the position of the meniscus pillar 99*a* can easily be controlled by such a simple structure that the application head 12B is provided with the projection portion 12*b*, and the projection portion 12*b* is opposed to the substrate 100. Thus, after the end of application of the coating material 99, the meniscus pillar 99*a*, which is formed by the excess coating material 99, can be located at the same position, and suction becomes easier. Therefore, there is no need to detect the meniscus pillar 99*a* by the second detection device 16, and the manufacturing cost of the coating apparatus 1B can be reduced.

In the meantime, the coating apparatuses 1, 1A and 1B according to the embodiments are not restricted to the above-described structures. In the above-described examples, the coating apparatus 1, 1A, 1B is configured such that the first moving device 17, which moves the substrate 100 that is the target and the application head 12 relative to each other, moves only the stage 11 that fixes the substrate 100, relative to the application head 12. However, the embodiments are not restricted to this configuration. For example, the first moving device 17 may be configured to move only the application head 12 in one direction relative to the stage 11 that fixes the substrate 100. Besides, the first moving device 17 may be configured to move both the stage 11, which fixes the substrate 100, and the application head 12 in opposite directions.

Additionally, in the above-described examples, the second moving device 18 is configured to move only the application head 12 in a direction away from the stage 11 that fixes the substrate 100 (for example, in a direction opposite to the direction of gravity). However, the second moving device 18 is not restricted to this configuration. Specifically, it should suffice if the second moving device 18 is configured to be capable of moving the substrate 100, which is the target, and the application head 12 relative to each other. Here, the second moving device 18 may be configured to move only the stage 11, which fixes the substrate 100, in a direction away from the application head 12 (for example, in the direction of gravity). Besides, the second moving device 18 may be configured to move both the stage 11, which fixes the substrate 100, and the application head 12 in directions away from each other.

Additionally, in the above-described examples, the projection portion 12*b* of the coating apparatus 1B is configured such that the apex part thereof is located at the central part in the width direction of the application head 12B. However, the projection portion 12*b* is not restricted to this configuration. For example, the projection portion 12*b* may be configured such that the apex part thereof is located on one end side of the application head 12B. Besides, the application head 12B may be configured to have a polygonal columnar shape, and the projection portion 12*b* may be provided on one of edge portions of the polygonal columnar shape.

Additionally, in the above-described examples, the coating apparatus 1, 1A is configured to include the rotating device 19, but the coating apparatus 1, 1A is not restricted to this configuration. For example, the coating apparatus 1, 1A may be configured not to include the rotating device 19, in the case of such a structure that the meniscus pillar forming portion 12*a* of the application head 12 of the coating apparatus 1, 1A is always opposed to the target 100.

Additionally, in the above-described examples, the coating apparatus 1A, 1B is configured to include the third moving device 34 which moves the suction nozzle 31, but the coating apparatus 1A, 1B is not restricted to this configuration. Since the coating apparatus 1A, 1B can execute such control as to locate at the same position the excess portion of the coating material 99, which forms the meniscus pillar 99*a*, the suction nozzle 31 may be configured to be fixed in advance at a position opposed to the meniscus pillar 99*a*.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A coating apparatus comprising:

an application head opposed to a coating surface of a target with a predetermined distance, and configured to form a meniscus pillar of a coating material between the application head and the coating surface;

a first moving device configured to move the application head relative to the target along the coating surface;

a second moving device configured to move the application head relative to the target in a direction in which the coating surface and the application head move away from each other and in a direction in which the coating surface and the application head move toward each other;

a feeding device configured to feed the coating material between the application head and the coating surface of the target;

a suction device that includes a suction portion independent of the application head and configured to suck the coating material;

a detection device configured to detect the meniscus pillar between the application head and the coating surface;

a third moving device configured to move the suction device to the meniscus pillar; and a control device configured to move, by controlling the second moving device, the application head and the coating surface relative to each other in a direction in which the application head and the coating surface move away from each other, after the coating material is applied to the coating surface, and to move, by controlling the third moving device, the suction device to the meniscus pillar detected by the detection device, wherein a distance between the application head and the coating surface is made greater than the predetermined distance, and the coating material is sucked from the meniscus pillar by the suction portion of the suction device, wherein when the application head is moved away from the coating surface and the meniscus pillar is formed, a distal end of the suction portion is opposed to the meniscus pillar to suck part of the coating material of the meniscus pillar, wherein the third moving device moves the suction device in a width direction of the application head and in a direction perpendicular to the width direction, wherein the control device is configured to control the detection device, wherein the detection device is configured to detect position information of the meniscus pillar and send the position information to the control device, and wherein the control device is configured to move, based on the position information of the meniscus pillar detected by the detection device, the suction portion of the suction device to a position for sucking the coating material of the meniscus pillar.

2. The coating apparatus of claim 1, wherein the second moving device is configured to move a position of the application head such that the distance between the application head and the coating surface is different between two points in a width direction of the application head.

3. The coating apparatus of claim 1, wherein the coating apparatus further comprises a rotating device configured to rotate the application head, the application head includes a projection portion on an outer peripheral surface of a part of the application head, the part being a part in a circumferential direction of the application head and being a part in a width direction of the application head, and the control device is configured to move, by controlling the second moving device, the application head in a direction away from the coating surface, after the coating material is applied to the coating surface, to rotate the application head, and to locate the projection portion such that the projection portion is opposed to the coating surface.

4. The coating apparatus of claim 1, wherein the suction portion includes a nozzle configured to move along an axial direction of the application head.

5. The coating apparatus of claim 1, wherein the suction portion sucks the coating material from the meniscus pillar at an application end point of application of the coating material, or sucks the coating material from the meniscus pillar when the application by the application head is stopped.

* * * * *